US006973704B2

(12) United States Patent
Cortigiano, Sr.

(10) Patent No.: US 6,973,704 B2
(45) Date of Patent: Dec. 13, 2005

(54) METHOD AND APPARATUS FOR POSITIONING SLIDERS FOR AUTOMATED SLIDER INSERTION

(75) Inventor: Ronald Cortigiano, Sr., Toccoa, GA (US)

(73) Assignee: Illinois Tool Works Inc., Glenview, IL (US)

( * ) Notice: Subject to any disclaimer, the term of this patent is extended or adjusted under 35 U.S.C. 154(b) by 73 days.

(21) Appl. No.: 10/208,645

(22) Filed: Jul. 30, 2002

(65) Prior Publication Data

US 2004/0020035 A1 Feb. 5, 2004

(51) Int. Cl.[7] ..... B21D 53/54; B21F 45/18; B29D 5/00; A41H 37/06

(52) U.S. Cl. ..... 29/409; 29/768; 29/408; 29/410; 29/766; 29/33.2

(58) Field of Search ..... 29/768, 766, 33.2, 29/408, 409, 410; 24/428

(56) References Cited

U.S. PATENT DOCUMENTS

| | | | | | |
|---|---|---|---|---|---|
| 3,701,191 | A | | 10/1972 | Laguerre | 29/207.5 |
| 3,701,192 | A | | 10/1972 | Laguerre | 29/207.5 |
| 4,355,461 | A | * | 10/1982 | Doori | 29/768 |
| 4,581,006 | A | * | 4/1986 | Hugues et al. | 493/213 |
| 4,882,824 | A | * | 11/1989 | Dziura et al. | 29/33.2 |
| 4,974,315 | A | * | 12/1990 | Yunoki | 29/768 |
| 4,980,968 | A | * | 1/1991 | Hilterhaus et al. | 29/768 |
| 5,103,555 | A | * | 4/1992 | Mizuno et al. | 29/768 |
| 5,113,567 | A | * | 5/1992 | Yunoki | 29/408 |
| 6,161,271 | A | * | 12/2000 | Schreiter | 29/408 |
| 6,199,256 | B1 | * | 3/2001 | Revnew et al. | 29/408 |
| 6,418,605 | B1 | * | 7/2002 | Kettner | 29/408 |
| 6,442,819 | B1 | * | 9/2002 | Kettner | 29/408 |
| 6,460,238 | B1 | * | 10/2002 | LaRue et al. | 29/408 |
| 6,584,666 | B1 | * | 7/2003 | Savicki | 29/408 |
| 6,666,626 | B2 | * | 12/2003 | McMahon et al. | 406/50 |
| 6,726,408 | B2 | * | 4/2004 | McMahon et al. | 406/50 |
| 6,796,015 | B2 | * | 9/2004 | Cortigiano, Sr. | 29/410 |
| 6,796,931 | B2 | * | 9/2004 | Cortigiano, Sr. | 493/213 |
| 6,836,945 | B2 | * | 1/2005 | Savicki | 29/408 |
| 6,842,973 | B2 | * | 1/2005 | Share et al. | 29/768 |
| 6,904,656 | B2 | * | 6/2005 | McMahon et al. | 29/408 |
| 2003/0167606 | A1 | * | 9/2003 | McMahon et al. | 24/428 |
| 2003/0183314 | A1 | * | 10/2003 | Share et al. | 156/66 |

FOREIGN PATENT DOCUMENTS

| | | | | |
|---|---|---|---|---|
| EP | 242214 | A1 * | 10/1987 | A44B 19/42 |
| GB | 2085519 | A | 4/1982 | |

* cited by examiner

*Primary Examiner*—Essama Omgba
(74) *Attorney, Agent, or Firm*—Ostrager Chong Flaherty & Broitman P.C.

(57) ABSTRACT

An apparatus for inserting a slider onto a flexible zipper tape, comprising: a zipper tape guide that supports a section of zipper tape in a slider insertion zone and guides advancement of the zipper tape along a line; a mechanism for displacing a slider from a pre-insertion position to an inserted position on the section of the zipper tape located in the slider insertion zone; and a slider guide for guiding the slider from a transition point to the pre-insertion position. The slider guide is configured so that the slider travels along a generally U-shaped path in its transit from the transition point to the pre-insertion position. The slider guide may be a channel configured to maintain one end of the slider constantly in the lead as it moves along the channel.

30 Claims, 11 Drawing Sheets

METHOD AND APPARATUS FOR POSITIONING SLIDERS FOR AUTOMATED SLIDER INSERTION

BACKGROUND OF THE INVENTION

This invention generally relates to slider-operated plastic zippers intended for use in reclosable pouches, bags or other packages. In particular, the invention relates to methods and apparatus for feeding sliders to a slider insertion device.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

Conventional slider-operated zipper assemblies typically comprise a plastic zipper having two interlocking profiles and a slider for opening and closing the zipper. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Other types of slider-operated zipper assemblies avoid the use of a separating finger. For example, U.S. Pat. No. 6,047,450 discloses a zipper comprising a pair of mutually interlockable profiled structures, portions of which form a fulcrum about which the profiled structures may be pivoted out of engagement when lower edges of the bases are forced towards each other.

An improvement in sliders is disclosed in U.S. patent application Ser. No. 10/096,409 filed on Mar. 11, 2002 and entitled "Insertion Apparatus for Attaching Sliders onto Zipper Bags and Film". This slider can be inserted on the zipper in a manner such that the zipper will be secured in the slider. As a result, during an opening of the reclosable bag the interlocking closure elements of the zipper will not unintentionally re-engage within the slider. For example, a re-engagement of the interlocking closure elements could occur when the zipper opening end of the slider is pushed toward a closed zipper park position. Such a re-engagement can occur during operation of the zipper or if the slider is inserted too far from a slider end stop on the zipper. By reducing the possibility of unintentional re-engagement of the interlocking members of the profiles, production of defective bags is reduced.

U.S. patent application Ser. No. 10/096,409 discloses a slider insertion apparatus comprising an activator that opens a first portion of a zipper tape, a pusher that inserts the slider onto a second portion of the zipper tape, and a zipper guide that holds a third portion of the zipper tape closed. The zipper guide and the activator with pusher are manufactured to facilitate forward movement of the zipper tape within the slider insertion apparatus; to properly position the profiles of a section of zipper for slider insertion; and to secure an adjacent section of the zipper when the slider is inserted. A loading rack with a supply of sliders may be part of the slider insertion apparatus, with the loading rack being a mechanically attachable device or module.

Systems for transporting sliders to a slider insertion device are disclosed in U.S. patent application Ser. No. 10/106,687 (incorporated by reference herein) filed on Mar. 25, 2002 and entitled "System for Transporting Sliders for Zipper Bags". That application discloses feeding sliders into a slider insertion device by means of a conduit that only accepts correctly oriented asymmetric sliders. It does not disclose a means for reversing the orientation of the sliders for certain applications without drastically increasing equipment costs.

For example, in certain circumstances it is possible to feed the sliders to the slider insertion machine only from the same side that the zipper tape is being fed. This is true in cases where the zipper tape advancement apparatus on the other side of the slider insertion device interferes with or precludes the installation of slider feeding apparatus on that other side. However, for different packaging applications, the orientation of the sliders being inserted onto zipper tape may differ. In one case, the sliders need to be inserted with the opening end of the slider leading in the direction of zipper tape advancement, while in another case, the sliders need to be inserted with the closing end leading. If the slider feeding apparatus can only be installed on the side of the slider insertion device opposite to the side on which the zipper tape advancing apparatus resides and if the slider feeding apparatus can only feed asymmetric sliders having a particular orientation, then in order to have the capability to apply sliders oriented in either direction, two separate slider feeding apparatus would be needed, one for each application. This increases equipment cost. There is a need for an economical solution that will allow the same slider feeding apparatus to be used for packaging applications that require slider insertion with a leading closing end and those that require slider insertion with a leading opening end.

BRIEF DESCRIPTION OF THE INVENTION

The present invention is directed to methods and apparatus for reversing the orientation of sliders at a pre-insertion position as compared to the orientation that would ordinarily be dictated by the design of an existing slider feeding apparatus.

One aspect of the invention is an apparatus for inserting a slider onto a flexible zipper tape, comprising: a zipper tape guide that supports a section of zipper tape in a slider insertion zone and guides advancement of the zipper tape along a line; a mechanism for displacing a slider from a pre-insertion position to an inserted position on the section of the zipper tape located in the slider insertion zone; and a channel that guides the slider from a transition point to the pre-insertion position. The channel has a contoured axis and a cross-sectional profile at each point along the contoured axis that is shaped to limit changes in orientation of the slider relative to the channel as the slider travels along the channel to a degree that the orientation of the slider follows the orientation of the section of the channel in which the slider is positioned. The channel is contoured so that the orientation of the slider, relative to a fixed frame of reference, changes during the transit from the transition point to the pre-insertion position by not less than 90 degrees.

Another aspect of the invention is an apparatus for inserting a slider onto a flexible zipper tape, comprising: a zipper tape guide that supports a section of zipper tape in a slider insertion zone and guides advancement of the zipper tape along a line; a mechanism for displacing a slider from a pre-insertion position to an inserted position on the section of the zipper tape located in the slider insertion zone; and a slider guide for guiding the slider from a transition point to the pre-insertion position. The slider guide is configured so that the slider travels along a generally U-shaped path in its transit from the transition point to the pre-insertion position.

A further aspect of the invention is an apparatus comprising: a slider insertion device that can be actuated to displace a slider from a pre-insertion position to an inserted position on a section of zipper tape located in a slider insertion zone, the slider insertion device comprising a first channel for guiding successive sliders from a slider entry point to the pre-insertion position; a tape drive assembly that can be actuated to advance the zipper tape in a first direction away from the slider insertion mechanism, the tape drive assembly being located on one side of the mechanism; and a slider feeder tube located on the other side of the slider insertion mechanism for feeding successive sliders toward the slider entry point, the slider feeder tube comprising a second channel that guides the slider from an entry end to an exit end. The exit end of the second channel is connected to the slider entry point. The first and second channels are aligned and in communication to allow sliders to pass from the slider feeder tube to the slider insertion device. Portions of the first and second channels at the channel connection are oriented so that sliders passing from the slider feeder tube to the slider insertion device are moving with a velocity component directed in the first direction, while a portion of the first channel proximal to the pre-insertion position is oriented so that sliders guided into the pre-insertion position are moving in a second direction generally opposite to the first direction.

A further aspect of the invention is a method for inserting a slider on a zipper tape, comprising the following steps: advancing the zipper tape in a first direction to a position whereat a slider insertion area on the zipper tape is situated in a slider insertion zone; guiding a slider from a source of sliders to a transition point where the slider is moving with a velocity component directed in the first direction while maintaining the slider with one end constantly in the lead; guiding the slider from the transition point to a pre-insertion position opposite the slider insertion area on the zipper tape while maintaining the slider with the one end constantly in the lead, the slider approaching the pre-insertion position by moving in a second direction generally opposite to the first direction; and inserting the slider from the pre-insertion position onto the slider insertion area of the zipper tape.

Yet another aspect of the invention is a method for inserting sliders on a zipper tape at spaced intervals therealong, comprising the following steps: intermittently advancing the zipper tape through a slider insertion zone, the advancement being in a first direction; transporting successive sliders from a starting point to a transition point near the slider insertion zone with an opening end of the slider constantly leading, each slider passing through the transition point with a velocity having a component parallel to the first direction; transporting each successive slider from the transition point to the slider insertion zone with the opening end of the slider constantly leading and with a rotation component, each successive slider intermittently entering the slider insertion zone with its opening end facing in a second direction opposite to the first direction; and intermittently inserting each successive slider in the slider insertion zone onto each successive section of the zipper tape residing in the slider insertion zone.

Other aspects of the invention are disclosed and claimed below.

DETAILED DESCRIPTION OF THE INVENTION

Figure 1:
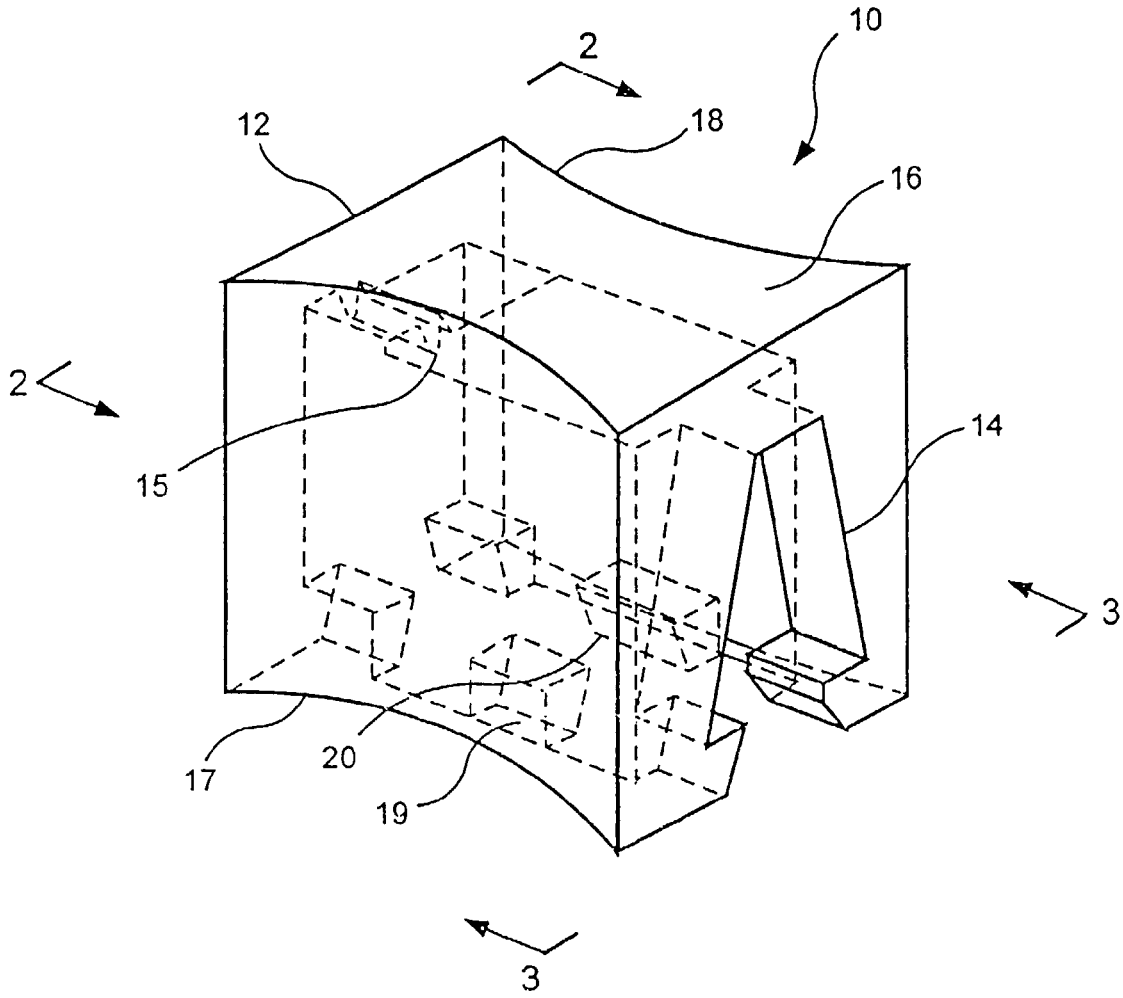
FIG. 1 is a drawing showing an isometric view of one type of slider that can be inserted on a zipper using the slider insertion apparatus disclosed herein.

Reference will now be made to the drawings, in which similar elements in different drawings bear the same reference numerals. For the purpose of illustration, the present invention will be described with reference to insertion of a slider of the type depicted in FIG. 1. However, application of the slider positioning system of the present invention is not limited to sliders of the type described below.

The slider 10 shown in FIG. 1 comprises a top wall 16 and opposing side walls or arms 17 and 18 integral with opposite sides of the top wall 16, forming a channel having a zipper opening end 12 and a zipper closing end 14. The slider comprises a keeper 15 extending downward from the top wall 16 and disposed between arms 17 and 18. The slider further comprises a plurality of mutually aligned, longitudinally extending retaining shoulders 19 projecting from the side wall 17, and a plurality of mutually aligned, longitudinally extending retaining shoulders 20 projecting from the side wall 18. The retaining shoulders 19 and 20 are shown as separate; however, the shoulders may be continuous along the length of the slider 10.

Figure 2:
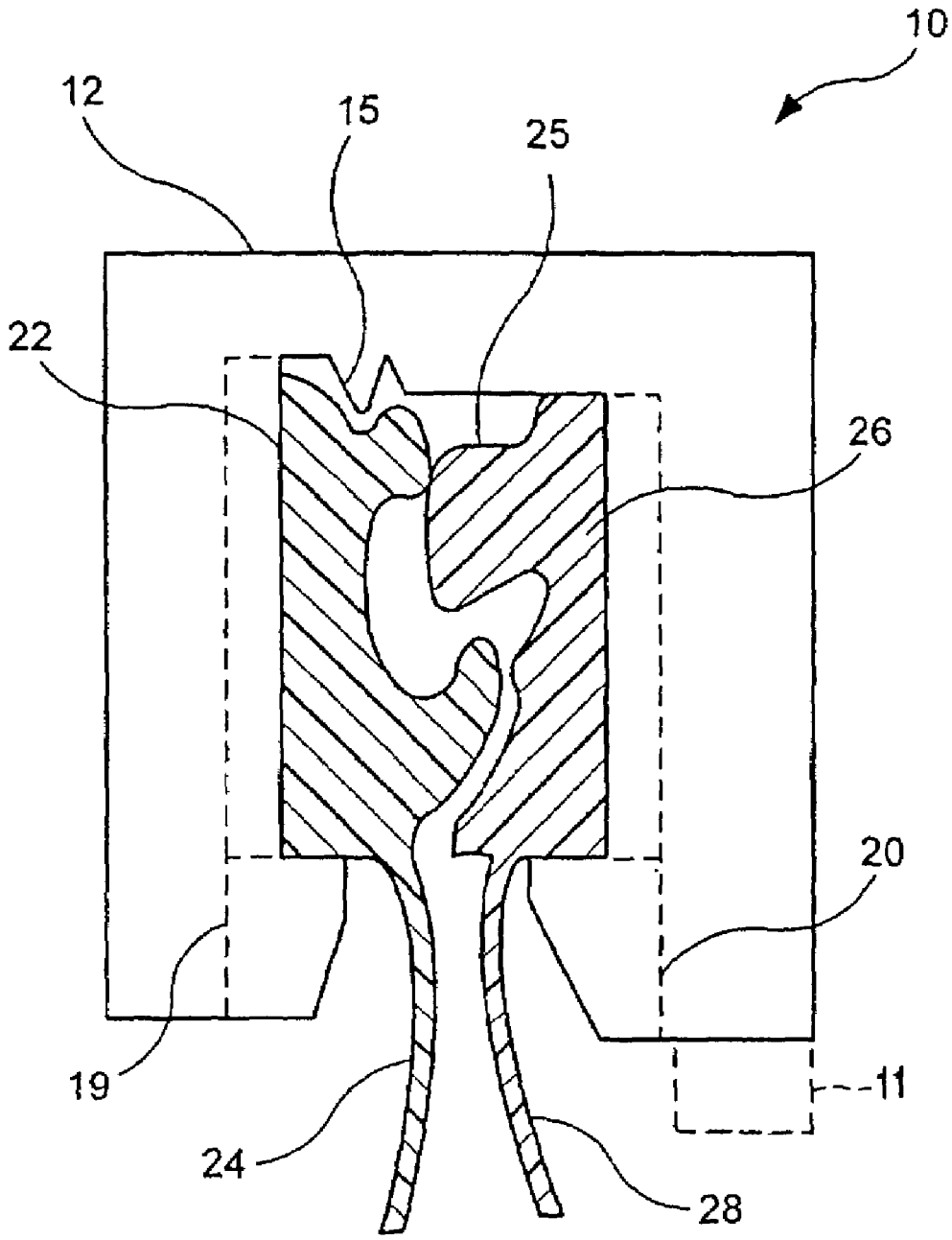
FIGS. 2 and 3 are drawings showing respective end views of the zipper opening end and zipper closing end of the slider depicted in FIG. 1, with the slider shown encompassing a portion of a zipper.

The keeper 15, as well as the retaining shoulders 19 and 20, secure a zipper within the slider 10, as shown in FIG. 2. FIG. 2 is an end view of the zipper opening end of the slider 10 with the slider shown encompassing a portion of a zipper 25 of a type known to those skilled in the art. In the state depicted in FIG. 2, the keeper 15 secures an interlocking member 22 of zipper part or half 24 of zipper 25 by preventing the interlocking member 22 from moving toward the mating interlocking member 26 of zipper part or half 28.

If the interlocking members are formed of a sufficiently stiff material, the interlocking member 22 may include a slight recess to accommodate the keeper 15. By preventing movement of the interlocking member 22 towards the interlocking member 26, the zipper parts 24 and 28 always remain partially disengaged at the opening end, thereby reducing the possibility of an unintentional full engagement of the interlocking members within the slider.

Figure 3:
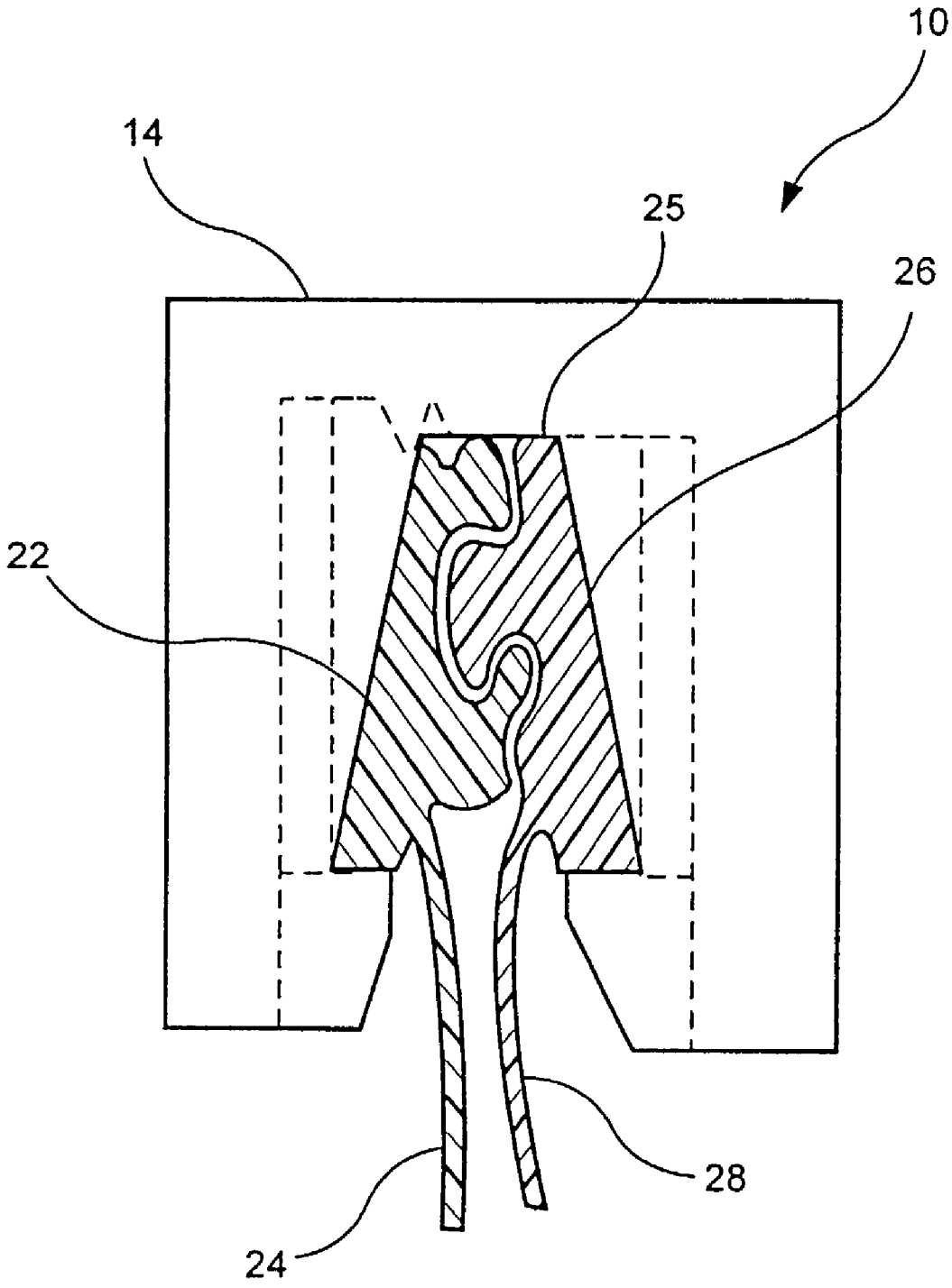

The arms of the slider are designed with interior surfaces having lower portions that converge in a direction from the opening end of the slider to the closing end, and having upper portions that diverge in the same direction. The lower portions on the interior surfaces of the slider arms 17 and 18 press the bottom edges of the interlockable members 22 and 26 toward each other when the slider is moved in the closing direction. These members are designed with surfaces that cooperate to form a fulcrum, about which the interlockable members rotate when their bottom edges are pressed together, causing the zipper portions above the fulcrum point to separate. In particular, the male and female profiles disengage, thereby opening the zipper as seen in FIG. 2. Conversely, when the slider is moved in the opposite or opening direction, the upper portions of the interior surfaces of the slider arms press the upper portions of the interlockable members 22 and 26 together, causing the zipper to close, as seen in FIG. 3.

Figure 4:
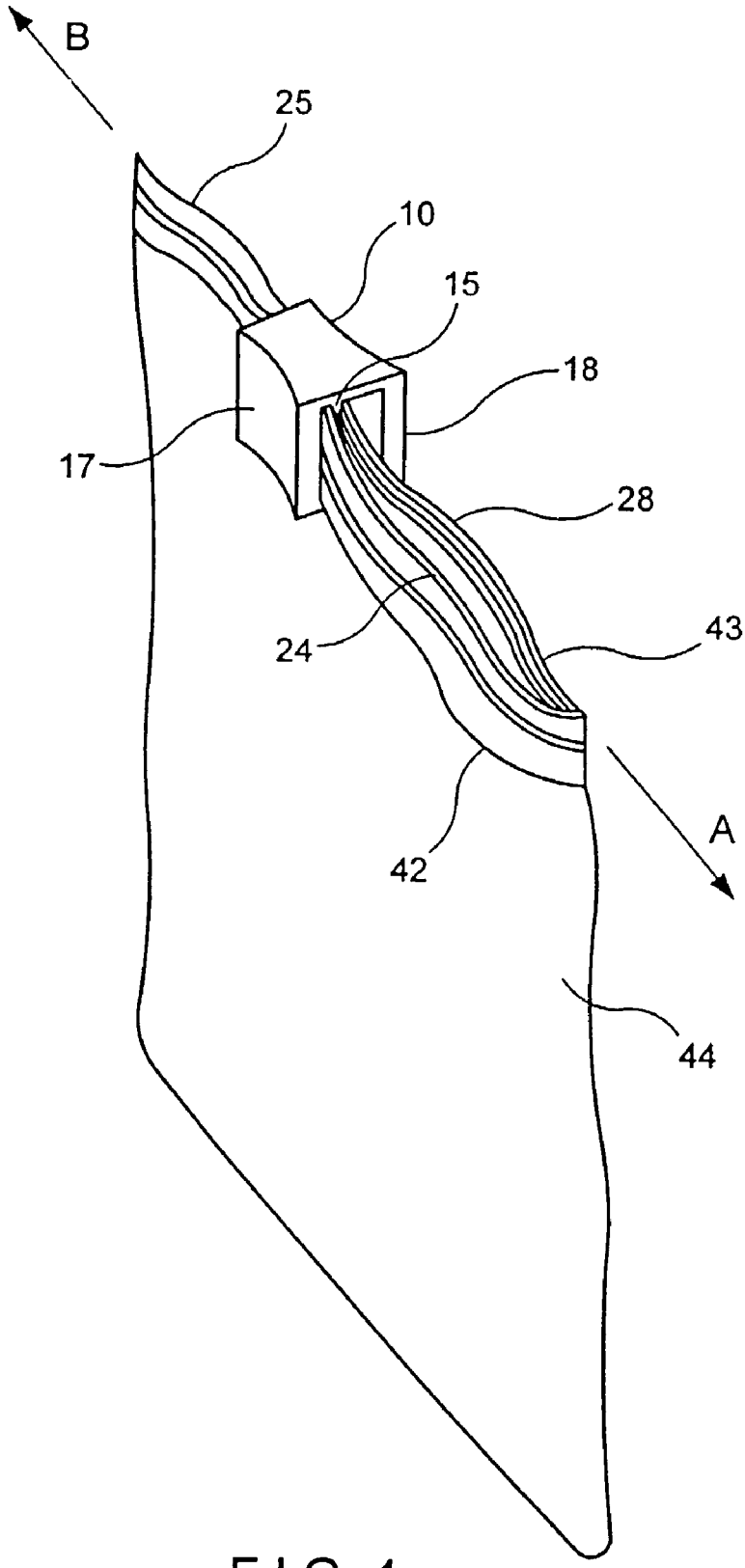
FIG. 4 is a drawing showing an isometric view of a reclosable plastic bag having a zipper operated by the slider shown in FIGS. 1–3.

FIG. 4 is an isometric view of a reclosable bag 44 incorporating a slider 10 and a zipper 25 of the above-described types. The zipper 25 is disposed across the transverse top edges 42 and 43 of the front and rear walls of reclosable bag 44. In use, the straddling slider 10 is slidable along the zipper in a closing direction A to cause the interlocking members 22 and 26 to be fully engaged. When the slider 10 is moved in an opening direction B, the interlocking members are disengaged by pinching the arms 17 and 18 at the zipper opening end 12 of the slider 10.

Figure 5:
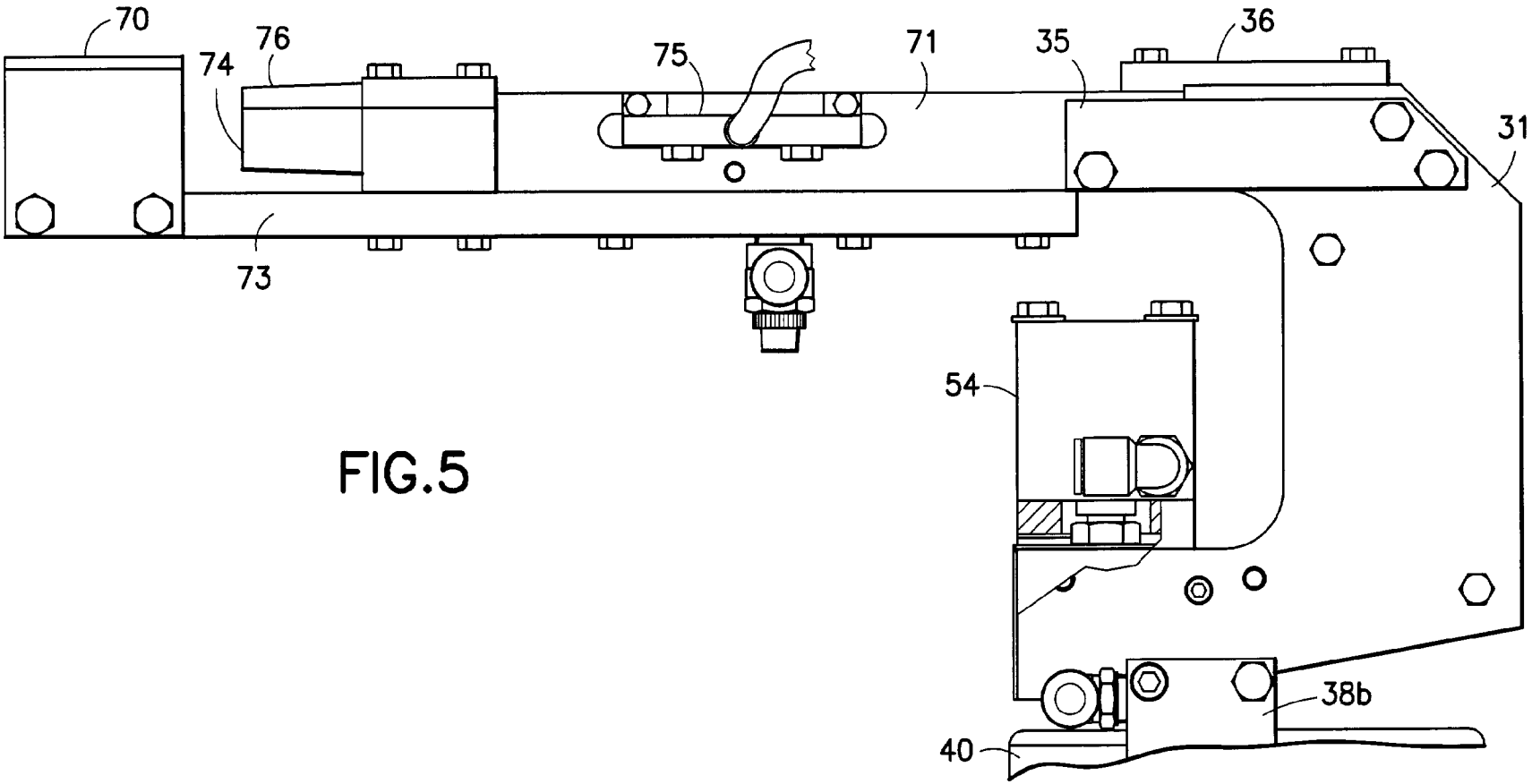
FIGS. 5 and 6 are drawings showing bottom and top views, respectively, of portions of a slider insertion apparatus in accordance with one embodiment of the present invention.
Figure 6:
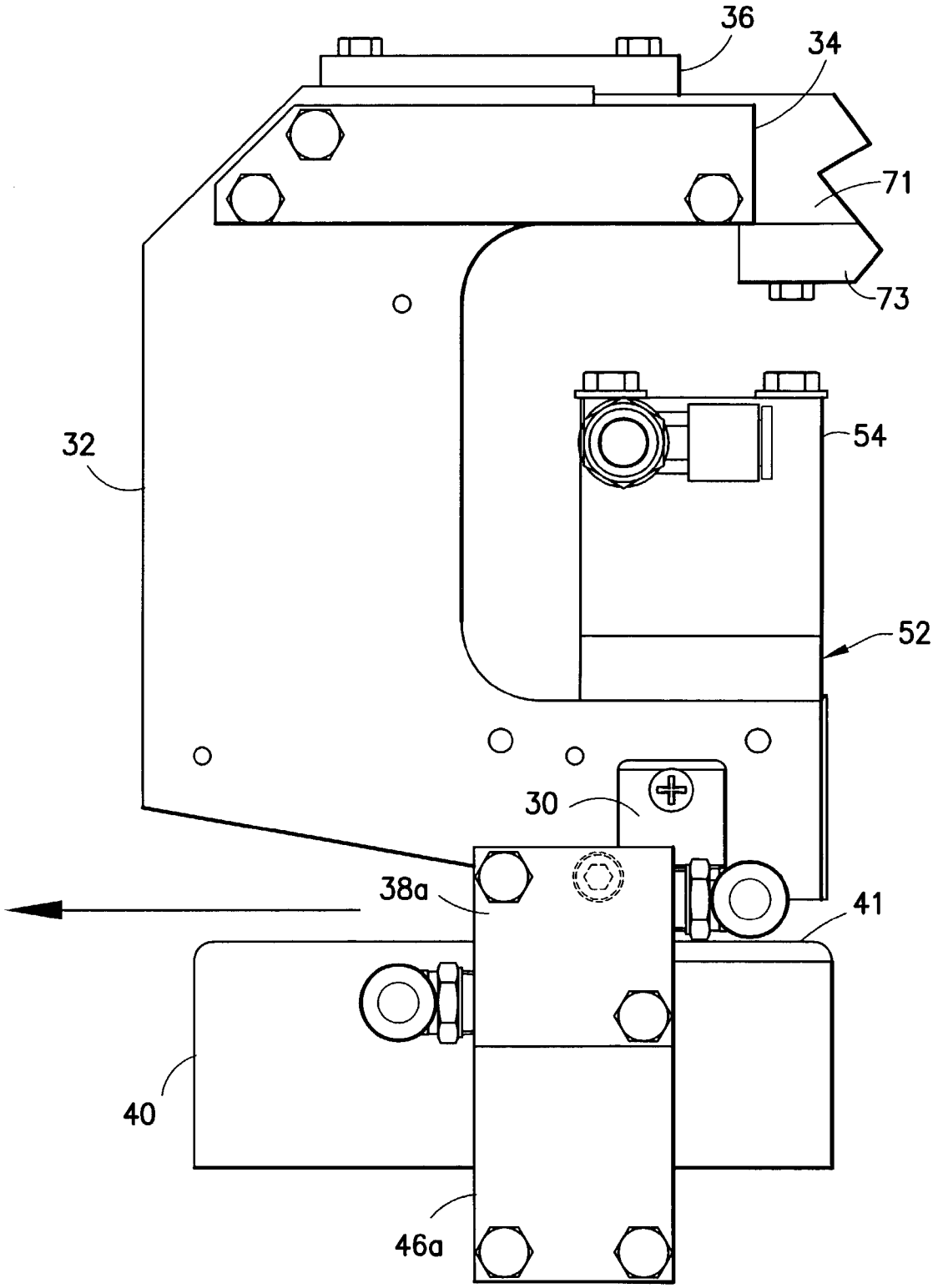

The present invention relates to an apparatus for automated insertion of sliders on zipper tape. One embodiment of such an apparatus is shown in FIGS. 5 and 6. FIG. 5 is a bottom view showing portions of the slider insertion apparatus from a slider entry point to a pre-insertion position at the terminus of a U-shaped slider base; FIG. 6 is a top view of some of the same parts, such as the U-shaped slider base, as well as other parts not visible in FIG. 5, such as the zipper guide.

Figure 7:
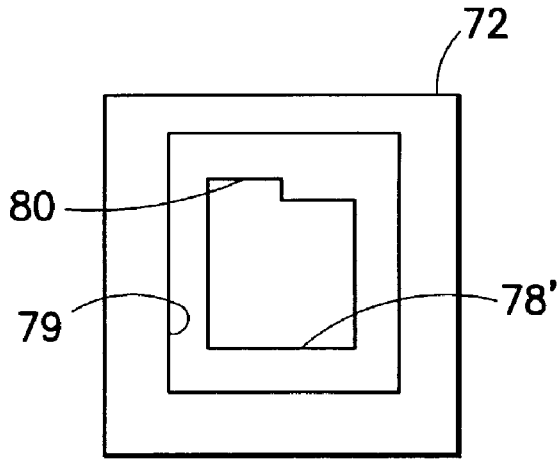
FIG. 7 is a drawing showing an exit end view of a feeder tube that feeds sliders from a source of sliders to the slider insertion apparatus depicted in FIGS. 5 and 6

The slider base comprises a U-shaped lower slider base 31 (seen in FIG. 5) and an upper slider base 32 (seen in FIG. 6), which are fastened together to form a U-shaped channel that reverses the orientation of the sliders to be inserted during their transit along the channel. The slider base 31/32 is connected to an air jet rail 71 by means of a pair of splice plates 34 (seen in FIG. 6) and 35 (seen in FIG. 5) and a support plate 36. The numeral 73 designates a cover for the air jet rail 71. The air jet rail has a channel for sliders that is aligned and in communication with an entry end of the U-shaped channel. A jet of air, produced by conventional means not shown, propels the sliders along the air jet rail and toward the slider base. The air jet rail 71 is in turn connected to a feeder tube connector 74 having a connector cap 76. The feeder tube connector 74 has a channel for sliders that is aligned and in communication with the channel of the air jet rail. The female end of a flexible feeder tube (shown in FIG. 7) is press-fit on and fastened to the tapered end of the feeder tube connector 74. As seen in FIG. 7, the feeder tube 72 has a channel 78 with a recess 80 that receives the projection 11 (see FIGS. 2 and 3) of each slider. Consequently, a slider of this construction may not enter the feed tube channel unless it has the orientation dictated by the channel profile, which in the disclosed embodiment is that the opening end of the slider be leading. The feeder tube also has a recess 79 shaped to receive the tapered end of the feeder tube connector 74. When the feeder tube is connected to the feeder tube connector, channel 78 of the feeder tube communicates with the channel inside the feeder tube connector.

The result is a continuous channel that runs from the remote end of the feeder tube to the pre-insertion position. The remote end of the feeder tube is, in turn, coupled to a source of sliders, such as a vibratory hopper (not shown). The feeder tube is made of a flexible material, such as polyurethane rubber (70 durometer). Other moldable resilient materials can also be used. A resilient material prevents the feeder tube from axially twisting or kinking, thereby allowing the feeder tube to be formed as a curved path from its remote end to the entry point on the slider insertion apparatus, i.e., feeder tube connector 74. The feeder tube is molded with a channel profile (seen in FIG. 7) that ensures efficient passage of the sliders without jamming during operation. In each section of this continuous channel, the slider in transit is maintained with one and the same end constantly in the lead. In the embodiment disclosed herein, the opening end of the slider leads throughout its transit from the source to the pre-insertion position.

Referring again to FIG. 5, sliders originating at the vibratory hopper (not shown) travel, in succession, through the feeder tube (not shown in FIG. 5), the feeder tube connector 74, the air jet rail 71, and the slider base formed by parts 31 and 32. The lead slider is stopped at the pre-insertion position when its leading end abuts the activating fork (described in detail below). Each successive slider takes its place at the end of the line of sliders, which line can extend all the way back to optical sensors supported by a pair of sensor mounts 75, only one of which is visible in FIG. 5, along the air jet rail 71. If the sensors detect the absence of a slider at the monitored location in the air jet rail, a signal is produced to the programmable controller that results in more sliders being supplied from the vibratory hopper in a manner disclosed in the aforementioned U.S. patent application Ser. No. 10/096,409. If a slider is detected at the monitored position, then no new sliders are supplied.

Figure 10:
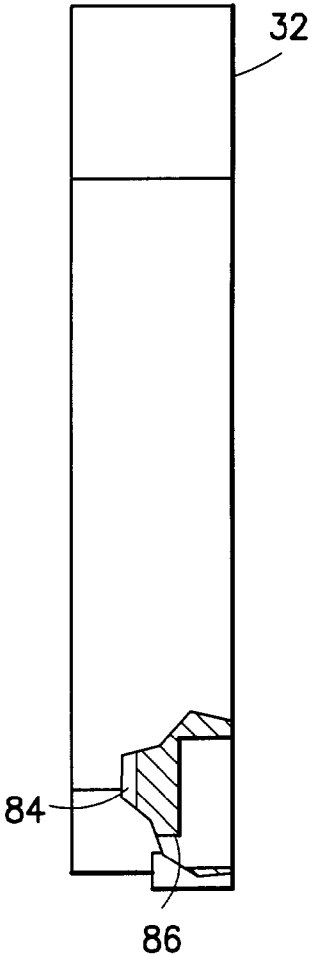
FIGS. 8–10 are drawings showing rear, bottom and front (partially sectioned) views of an upper slider base incorporated in the apparatus depicted in FIGS. 5 and 6.
Figure 9:
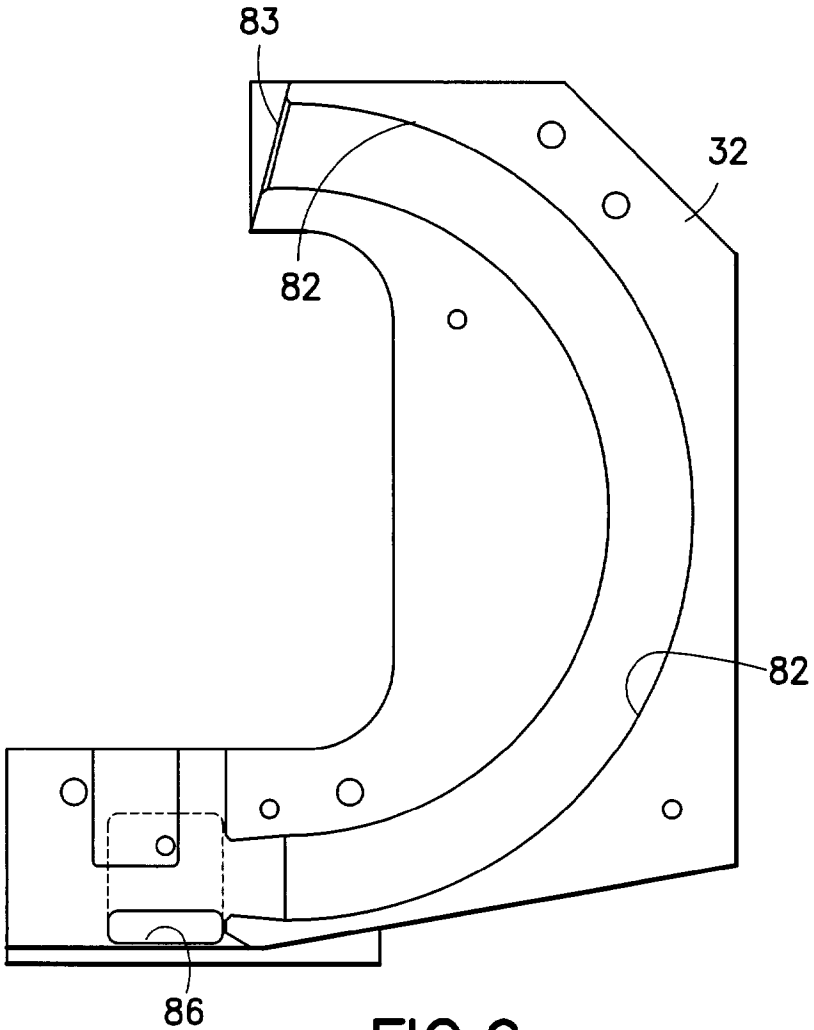
Figure 8:
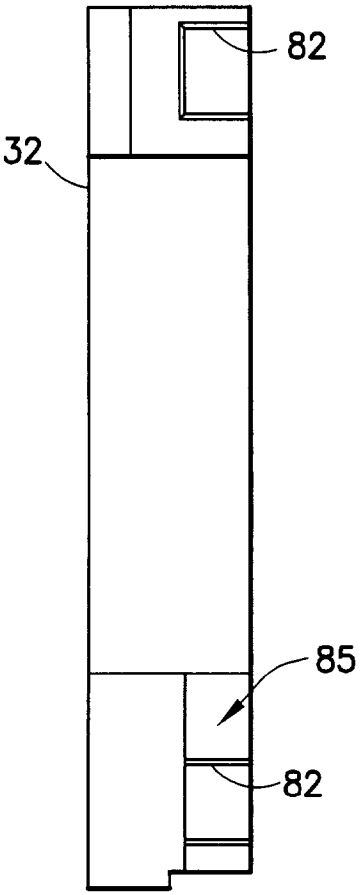

The structure of the upper slider base 32 is shown in FIGS. 8–10. As best seen in FIG. 8, upper slider base 32 has a generally U-shaped recess 82 on one side which is covered by the opposing flat surface of the lower slider base, forming a U-shaped slider channel when the lower slider base is fastened to the upper slider base. The entrance 83 at the top of the recess represents a transition point in the transit of the slider from the air jet rail to the slider base. The slider channel formed by the covered recess 83 has a contoured axis and a cross-sectional profile at each point along the contoured axis that is shaped to limit changes in orientation of the moving slider relative to the channel. The slider follows the orientation of each section of the channel through which the slider passes. In the disclosed embodiment, the channel is contoured so that the orientation of the slider, relative to a fixed frame of reference, changes during its transit from the transition point to the pre-insertion position by 180 degrees. However, it is within the scope of the present invention to change the angle of the air jet rail relative to the zipper tape guide so that the slider is rotated by less than 180 degrees (but not less than 90 degrees).

The upper slider base 32 also has a recess 84 on its opposite side for receiving a capture spring assembly (item 30 in FIG. 6). The terminus of the curved recess 82 communicates with an offset 85 (best seen in FIG. 8), in which the activator with pusher (not shown in FIG. 8) operate and in which the next slider to be inserted is held in a pre-insertion position. The upper slider base further comprises a channel 86, by means of which the recess for the capture spring assembly communicates with the slider insertion zone, i.e., the zone traversed by a slider during an insertion operation. The capture spring passes through channel 86 and projects into the slider insertion zone at a position where the short leg of an incoming slider will sit atop of the capture spring and thus the slider will be held in the pre-insertion position.

The slider insertion operation will now be described with reference to FIGS. 11–13. As previously described, when the slider arrives at a pre-insertion position under the activator with pusher 52 (see FIG. 11), the capture spring holds the correctly oriented slider in place. During subsequent slider insertion, the pusher 53 (see FIG. 13) will push the slider 10 toward the zipper tape 25 with sufficient force to overcome the holding force being applied by the capture spring. The activator with pusher 52 is moved from a retracted position to an extended position by an air cylinder 54 for inserting a slider onto an underlying section of the zipper tape.

In addition to the slider being correctly positioned prior to insertion, the zipper tape must also be correctly positioned and supported in that correct position during slider insertion. As previously described, a zipper comprises interlockable zipper parts, each zipper part comprising a profiled closure element and an zipper flange connected to the closure element. The closure elements have complementary male and female profiles that enable the closure elements to be interlocked when engaged by the moving slider during use by the consumer. Each zipper is cutoff from a continuous zipper tape. Thus, the zipper tape has the same profile as that of the zipper in the completed reclosable package. For the purpose of illustrating the present invention, the zipper gripping and slider insertion operations will be described with reference to a zipper tape having the profile of the closed zipper depicted in FIG. 3.

Figure 11:
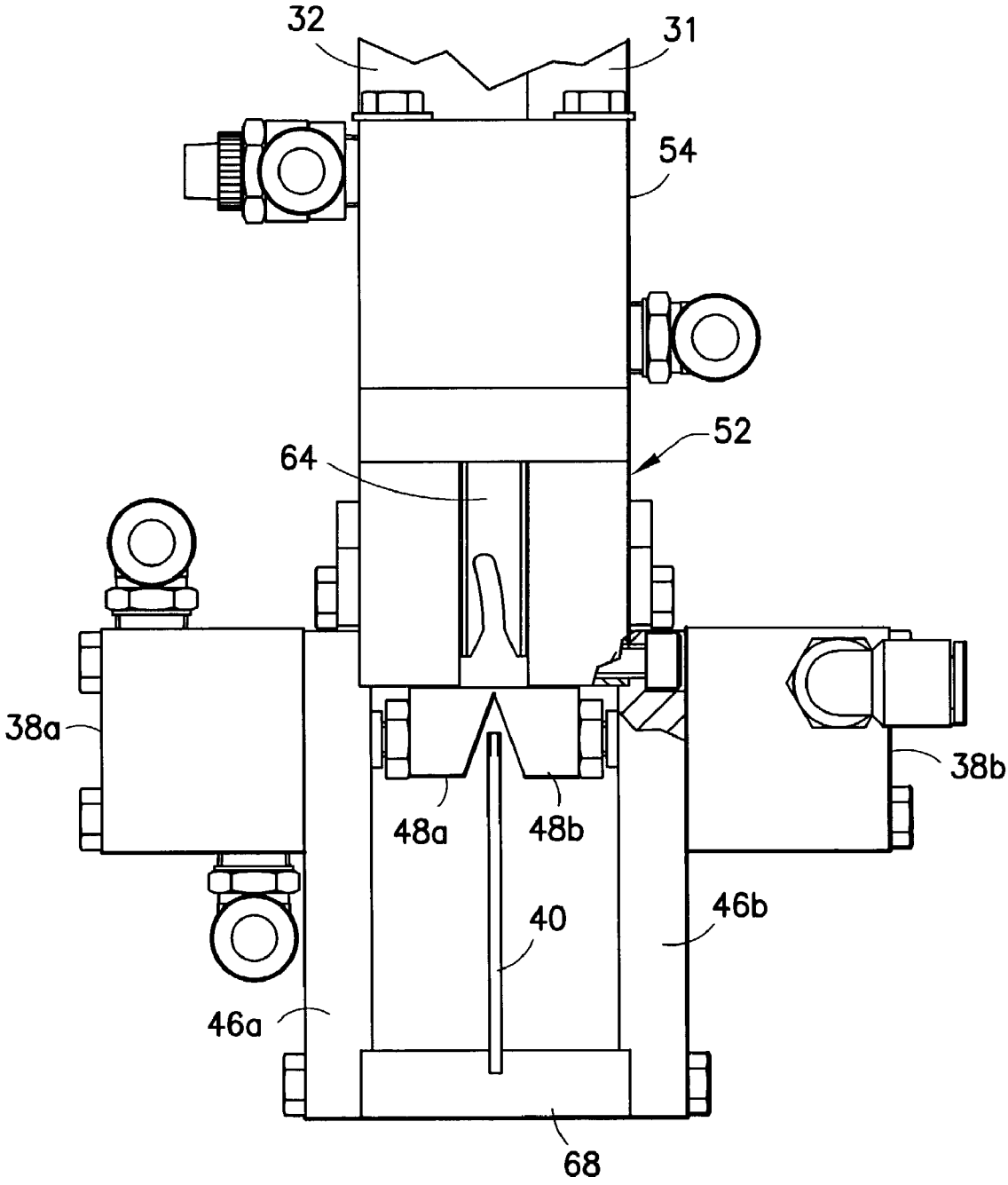
FIG. 11 is a drawing showing a rear end view of the slider insertion apparatus depicted in FIGS. 5 and 6.
Figure 12:
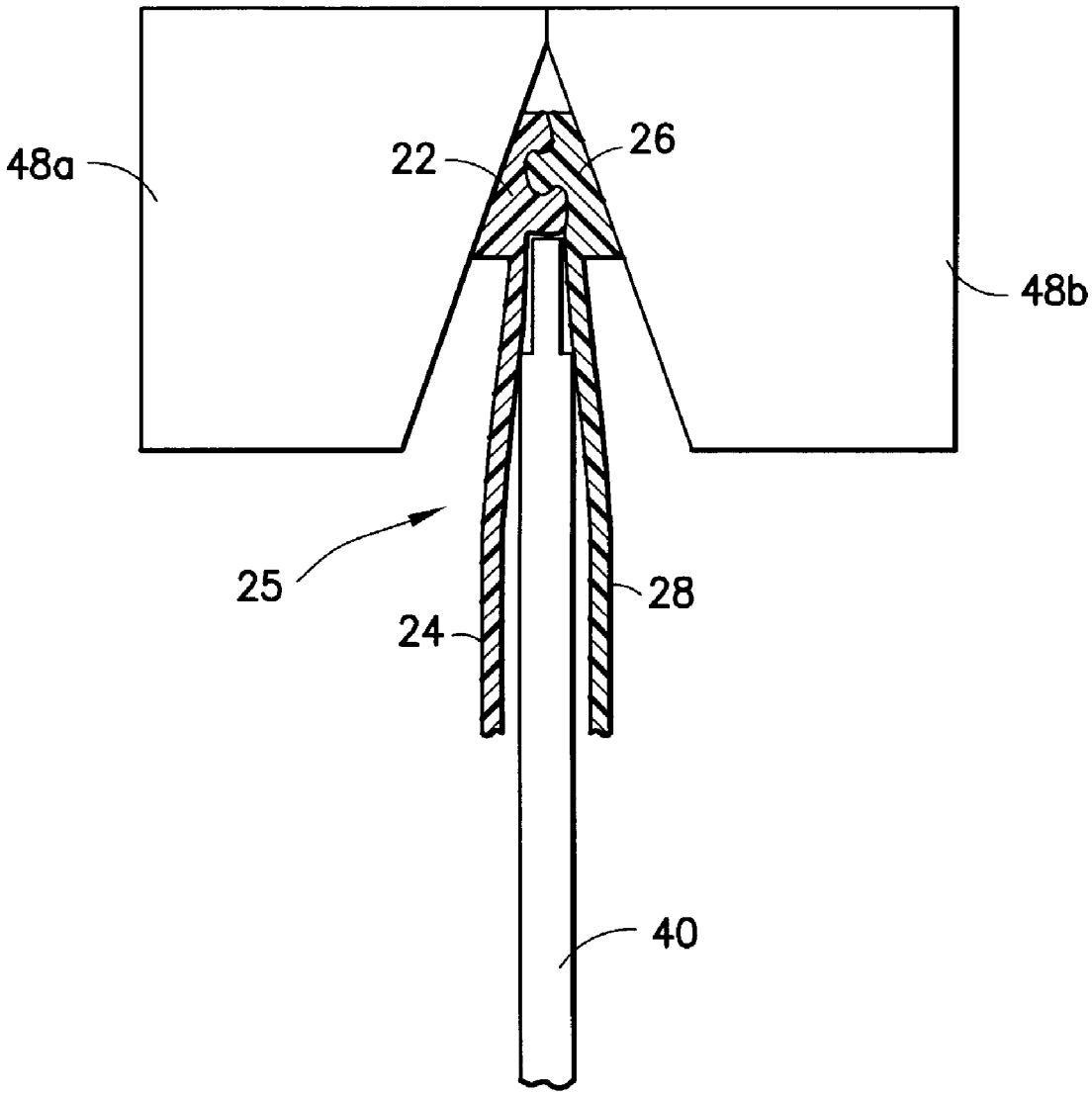
FIG. 12 is a drawing showing a partially sectioned end view of the zipper tape and means for gripping the zipper tape, the latter forming part of the slider insertion apparatus depicted in FIG. 11.

In the automated slider insertion apparatus depicted in FIG. 11, the zipper tape is threaded over a saddle 40 comprising an elongated upright plate. The bottom edge of the saddle 40 is welded in a groove formed in a guide weldment 68. The saddle 40 extends substantially perpendicular to guide weldment 68, which is fastened on opposing sides to respective hanger plates 46*a* and 46*b*. The hanger plates are in turn fastened to the slider base 32, extending in parallel to each other. The hanger plates 46*a* and 46*b*, in combination with the connecting guide weldment 68, provide a structure for supporting the saddle 40 in a fixed position below the slider base. As will be described below, the hanger plates also support respective air cylinders 38*a* and 38*b* for moving respective gripper fingers 48*a* and 48*b* that grip the zipper tape during slider insertion.

As seen in FIG. 6, the saddle 40 has a straight contact edge 41. The zipper tape sits against contact edge 41 during slider insertion and slides along edge 41 during zipper tape advancement. The positional relationship of the saddle edge 41 and the zipper tape 25 is shown in FIG. 12. The saddle 40 is flanked by the zipper flanges 24 and 28 of the interlocked zipper halves, while the underbelly of an opposing section of the zipper tape sits against the contact edge 41 of the saddle 40.

To ensure that the zipper tape is correctly positioned prior to slider insertion, a pair of gripper fingers 48*a* and 48*b*, disposed on opposite sides of the zipper tape 25, grip a section of the zipper tape that is adjacent to the section of zipper tape on which the slider will be inserted. Each gripper finger is movable between respective extended and retracted positions by operation of air cylinders 38*a* and 38*b*. The gripper fingers are alternately extended concurrently and retracted concurrently. The gripper fingers 48*a* and 48*b* grip the zipper tape 25 when the gripper fingers are in their extended positions (as seen in FIG. 12); the gripper fingers do not grip the zipper tape when the gripper fingers are not in their extended positions. The extended gripper fingers form a V-shaped space therebetween that is intersected by the contact edge 41 of the saddle 40. When the gripper fingers are in their fully retracted positions, there is sufficient clearance between the gripper fingers and the saddle for the zipper tape with an inserted slider thereon to pass through, which is not the case when the gripper fingers are extended.

In the disclosed embodiment, each gripper finger comprises a respective angled block. However, the grippers may have other geometries. The inclined surface of each angled block, which surface contacts the zipper, may optionally be textured or serrated to facilitate gripping of the inclined surfaces of the A-shaped zipper tape. However, pressure applied by smooth surfaces is also deemed to be "gripping". In the extended positions shown in FIG. 12, the gripper fingers 48*a* and 48*b* push the closure members of the zipper halves together and against the top of the saddle 40, thereby securely holding a first section of zipper tape in a fixed and proper position for receiving a slider.

Figure 13:
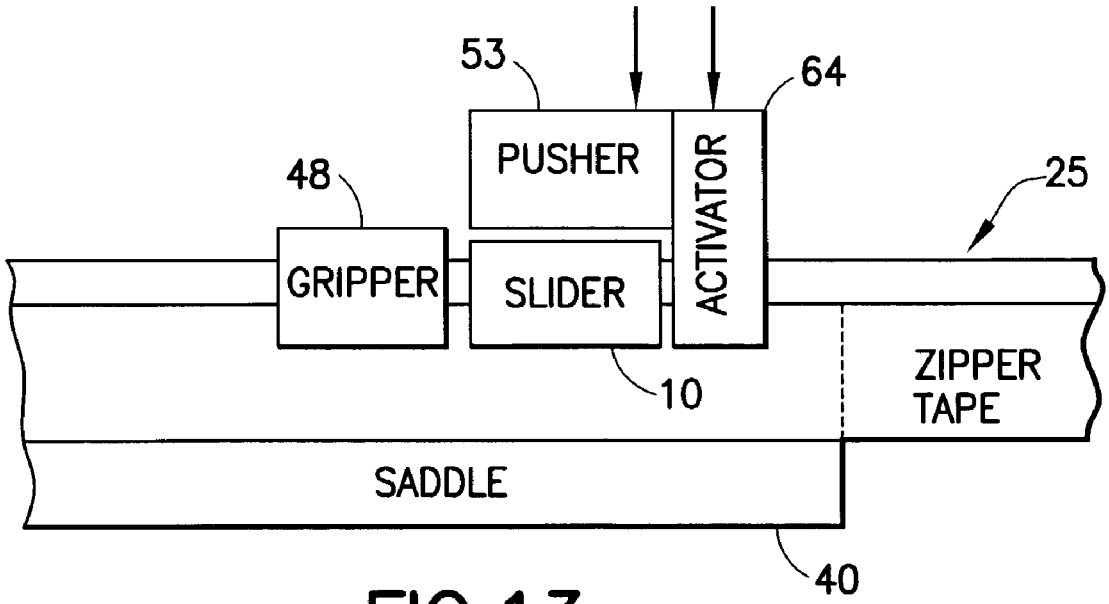
FIG. 13 is a schematic showing a side view of various parts of the disclosed embodiment in relation to a slider being inserted on a zipper tape.

Referring now to FIG. 13, while a first section of the zipper tape 25 is held closed by the gripper 48, the activator 64 and the pusher 53 perform the zipper activation and slider insertion functions respectively. In particular, the activator and pusher are moved from a retracted position to an extended position by activation of an air cylinder (item 54 in FIG. 6). The activator 64 has the shape of a fork (as seen in FIG. 6). During the extension stroke, the activating fork 64 engages a second section of the zipper tape 25, while the pusher 53 pushes a slider 10 onto a third section of the zipper tape 25. The gripper fingers, pusher and activating fork are arranged so that the inserted slider lies between the extended gripper fingers and the extended activating fork. The arrow in FIG. 13 (as well as the arrows in FIGS. 5 and 6) indicates the direction of zipper tape advancement following each slider insertion. Thus, on the leading side of the slider insertion area the zipper tape 25 is held closed by the gripper 48, while on the lagging side of the slider insertion area the zipper tape 25 is opened by the activating fork 64, which has the effect of opening an adjacent portion of the zipper tape in the slider insertion area, where keeper 15 (see FIG. 2) of the slider 10 will engage the female zipper profile.

More specifically, the activating fork 64 offsets the interlocking closure members in a section of the zipper tape adjacent the slider insertion area. This causes the offset portions to disengage, i.e., open partly. Referring back to FIG. 2, when the interlocking closure members 22 and 26 are offset in relation to each other, the keeper 15 can properly secure the interlocking member 22. Thus, the zipper section at the opening end of the slider is activated in the sense of being held partly open by the keeper. Coinciding with the movement of the activating fork 64 the pusher 53 inserts the slider 10 on the zipper tape 25. As the slider is inserted, the inclined side surfaces of the A-shaped zipper shown in FIGS. 2 and 3 cause the slider side walls to flex outward. The slider returns to an unflexed state when the projections directed inward from the bottoms of the slider side walls latch under the bottoms of the zipper profiles.

As previously mentioned, the extension and retraction of the gripper fingers 48*a* and 48*b* and the pusher 53 are achieved in the disclosed embodiment by means of respective air cylinders 38*a*, 38*b* and 54, shown in FIG. 6. Alternatively, hydraulic cylinders could be used. Operation of the cylinders is controlled by a programmable controller (not shown), which selectively activates the supply of fluid to the cylinders in accordance with an algorithm or logical sequence. The controller may also take the form of a computer or a processor having associated memory that stores a computer program for operating the slider insertion apparatus. The controller is programmed to control cylinders 38*a*, 38*b* and 54 so that the slider is inserted by pusher 53 only while the gripper fingers 48*a* and 48*b* are in their respective extended positions. The controller is further programmed to control cylinders 38*a* and 38*b* so that the gripper fingers move from their respective retracted positions to their respective extended positions concurrently and vice versa. The controller is further programmed to activate a tape drive assembly for intermittently advancing the zipper tape after each slider insertion.

Figure 14:
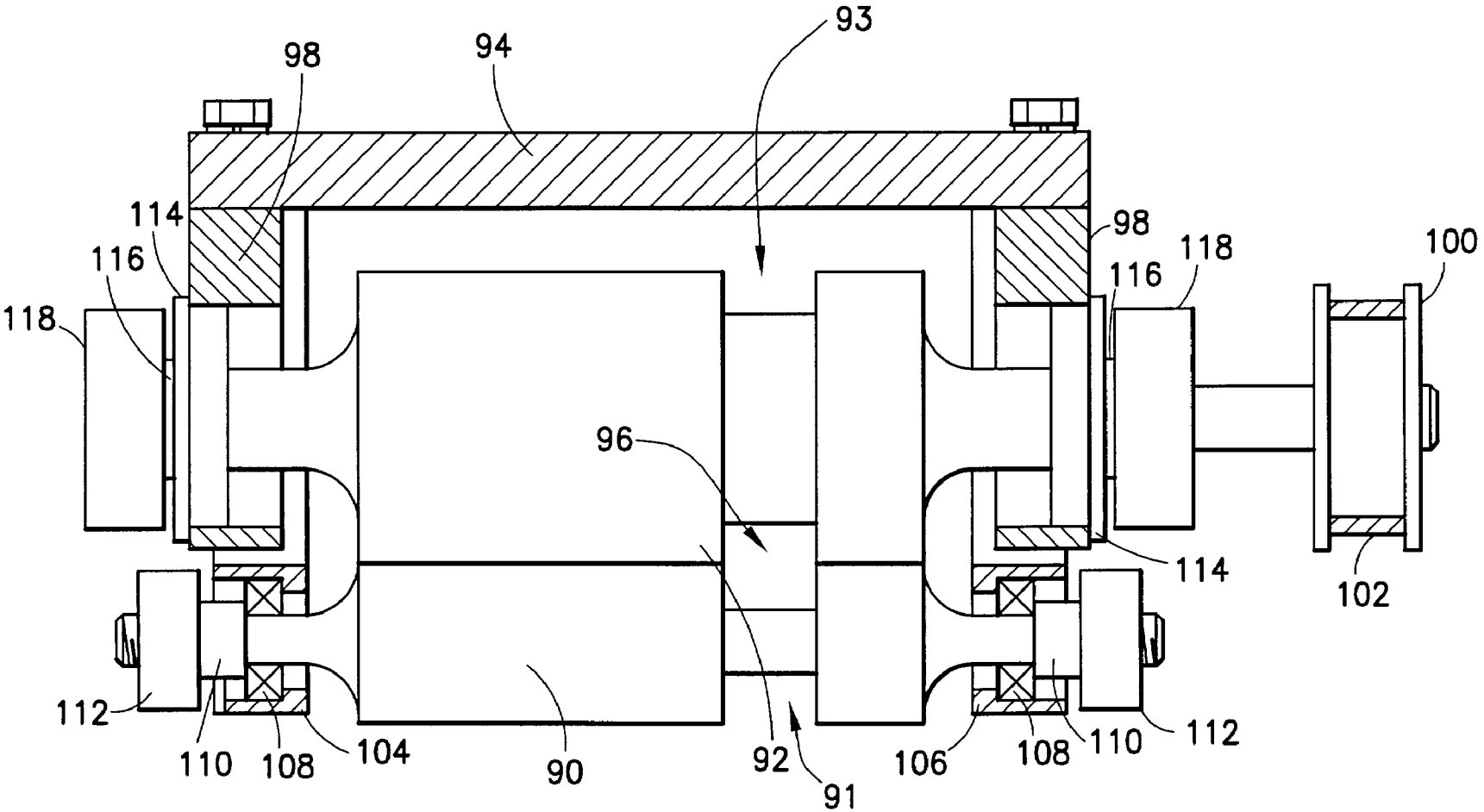
FIG. 14 is a drawing showing a front view of part of a tape drive assembly that can be used to advance the zipper tape on which the apparatus disclosed herein inserts sliders.

One type of tape drive assembly is shown in FIG. 14. This assembly pulls the zipper tape of connected slider-zipper assemblies forward, toward the tape application station. The tape drive mechanism comprises an idler roller 90 and a nip roller 92 having roller faces that meet squarely to form a nip. The zipper flanges of the tape segment exiting the slider guide are threaded through the nip. The nip roller 92 is rotatably supported by respective flanged bearings 114 mounted to an adjustment plate 94 by means of respective bearing housings 98 at opposite ends of the nip roller 92. The means for adjusting the vertical position of the adjustment plate 94 are not shown. The nip roller 92 is held in position by a pair of spacers 116 and threaded set collars 118. A gearbelt pulley 100 is mounted to the end of the shaft of the nip roller. The pulley is driven by a gearbelt 102 (shown in section in FIG. 14), causing the nip roller 92 to rotate. A programmable controller (not shown) controls a servomotor (also not shown), which in turn drives the pulley 100, causing the nip roller 92 to rotate to the extent needed to feed the tape one zipper increment. The pressure exerted by the nip roller 92 on the idler roller 90 in turn causes the idler roller 90 to rotate in the opposite direction. The idler roller 90 is rotatably supported at its ends by respective bearings 108 seated in mounting plates 104 and 106 respectively. The idler roller 90 is held in position by a pair of spacers 110 and threaded set collars 112.

The zipper tape with sliders inserted thereon is guided toward the tape drive assembly shown in FIG. 14 by a slider guide not shown. The sliders travel along a straight channel in the slide guide, while the zipper flanges pass through and protrude out a slot in the side of the slider guide. When the nip roller is rotated, the friction and compression caused by the surface of the nip roller in contact with the zipper flanges pushes the zipper flanges through the nip. The idler roller 90 has an annular groove 91 and the nip roller 92 has an annular groove 93. The groove 91 and 93 are equal in width and are aligned to form a space 96 which is shaped and sized to allow passage therethrough of the sliders mounted on the advancing zipper tape.

The nip roller 92 remains stationary while the slider-zipper assembly at the end of the tape is sealed to the bag making film and cut off. At the same time, the slider insertion machine is inserting another slider on the zipper tape. Then the bag making film is indexed in the machine direction one package length and the zipper tape with sliders inserted thereon is indexed in the transverse direction one zipper length, following which the slider insertion and zipper application operations are repeated.

A person skilled in the art of machinery design will readily appreciate that displacing means other than cylinder can be used to insert the slider on the zipper tape. Any other known mechanical displacement means can be used. For the sake of illustration, such mechanical displacement devices include rack and pinion arrangements, rotation of the pinion being driven by an electric motor.

Also, although the slider insertion apparatus has been depicted in the drawings in a horizontal orientation, it will be appreciated by persons skilled in the art that the slider insertion apparatus disclosed herein operates equally well in a vertical plane for applications wherein the zipper tape is oriented in a vertical plane.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. An apparatus for inserting a slider onto a flexible zipper tape, comprising:

a zipper tape guide that supports a section of zipper tape in a slider insertion zone and guides advancement of said zipper tape along a line;

a mechanism for displacing a slider from a pre-insertion position to an inserted position on said section of said zipper tape located in said slider insertion zone; and a channel that surrounds and guides said slider from a transition point to said pre-insertion position, wherein said channel has a contoured axis and a cross-sectional profile at each point along said contoured axis that is shaped to limit changes in orientation of said slider relative to said channel as said slider travels along said channel to a degree that the orientation of said slider follows the orientation of a section of said channel in which said slider is positioned, said channel being contoured so that the orientation of said slider, relative to a fixed frame of reference, changes during transit from said transition point to said pre-insertion position by not less than 90 degrees, said slider contacting only said channel during said transit from said transition point to said pre-insertion position.

2. The apparatus as recited in claim 1, wherein said channel is contoured so that the orientation of said slider, relative to said fixed frame of reference, changes from said transition point to said pre-insertion position by approximately 180 degrees.

3. The apparatus as recited in claim 1, wherein said channel is generally U-shaped.

4. The apparatus as recited in claim 1, further comprising an air jet rail in communication with said channel and providing an air jet that propels sliders in a predetermined direction toward said transition point of said channel.

5. The apparatus as recited in claim 4, further comprising a tape drive assembly for advancing said zipper tape in said predetermined direction in time intervals between slider insertions.

6. The apparatus as recited in claim 1, wherein said mechanism comprises:

a pusher movable from a retracted position to an extended position for inserting said slider from said pre-insertion position to said inserted position; and an actuator for moving said pusher between said retracted and extended positions.

7. The apparatus as recited in claim 6, wherein said actuator comprises a cylinder.

8. The apparatus as recited in claim 7, wherein said cylinder is operated pneumatically.

9. The apparatus as recited in claim 1, further comprising a support structure, said channel being incorporated in said support structure, and said zipper guide and said mechanism being supported by said support structure.

10. The apparatus as recited in claim 9, wherein said support structure comprises first and second base parts fastened together, said first base part comprising a contoured recess that is covered by said second base part to form said channel.

11. The apparatus as recited in claim 10, further comprising a spring for supporting said slider in said pre-insertion position, said spring being supported by said first base part, a portion of said spring projecting into said recess.

12. An apparatus for inserting a slider onto a flexible zipper tape, comprising:

a zipper tape guide that supports a section of zipper tape in a slider insertion zone and guides advancement of said zipper tape along a line;

a mechanism for displacing a slider from a pre-insertion position to an inserted position on said section of said zipper tape located in said slider insertion zone; and a slider guide for guiding said slider from a transition point to said pre-insertion position, wherein said slider guide is configured so that said slider travels along a generally U-shaped path in its transit from said transition point to said pre-insertion position, and wherein said slider guide surrounds said slider so that said slider contacts only said slider guide during its travel along said generally U-shaped path.

13. The apparatus as recited in claim 12, wherein said slider guide comprises a channel for guiding said slider along said U-shaped path.

14. The apparatus as recited in claim 13, wherein channel has a contoured axis and a cross-sectional profile at each point along said contoured axis that is shaped to limit changes in orientation of said slider relative to said channel as said slider travels along said channel to a degree that the orientation of said slider follows the orientation of the section of said channel in which said slider is positioned.

15. The apparatus as recited in claim 13, further comprising an air jet rail in communication with said channel and providing an air jet that propels sliders in a predetermined direction toward said transition point of said channel.

16. The apparatus as recited in claim 15, further comprising a tape drive assembly for advancing said zipper tape in said predetermined direction in time intervals between slider insertions.

17. The apparatus as recited in claim 15, further comprising a sensor mounted to said air jet rail for detecting the absence of a slider at a predetermined position in said air jet rail.

18. The apparatus as recited in claim 12, wherein said slider guide comprises first and second guide parts fastened together, said first guide part comprising a contoured recess that is covered by said second guide part to form said channel.

19. The apparatus as recited in claim 18, further comprising a spring for supporting said slider in said pre-insertion position, said spring being supported by said first guide part, a portion of said spring projecting into said recess.

20. An apparatus comprising:

a slider insertion device that can be actuated to displace a slider from a pre-insertion position to an inserted position on a section of zipper tape located in a slider insertion zone, said slider insertion device comprising a first channel for guiding successive sliders from a slider entry point to said pre-insertion position;

a tape drive assembly that can be actuated to advance said zipper tape in a first direction away from said slider insertion mechanism, said tape drive assembly being located on one side of said mechanism; and a slider feeder tube located on the other side of said slider insertion mechanism for feeding successive sliders toward said slider entry point, said slider feeder tube comprising a second channel that guides said slider from an entry end to an exit end, wherein said exit end of said second channel is connected to said slider entry point, said first and second channels being aligned and in communication to allow sliders to pass from said slider feeder tube to said slider insertion device, wherein portions of said first and second channels at said channels connection are oriented so that sliders passing from said slider feeder tube to said slider insertion device are moving with a velocity component directed in said first direction, and a portion of said first channel proximal to said pre-insertion position is oriented so that sliders guided into said pre-insertion position are moving in a second direction generally opposite to said first direction.

21. The apparatus as recited in claim 20, wherein said first channel comprises a section that is U-shaped.

22. The apparatus as recited in claim 20, wherein said first channel has a contoured axis and a cross-sectional profile at each point along said contoured axis that is shaped to limit changes in orientation of a slider relative to said first channel as said slider travels along said first channel to a degree that the orientation of said slider follows the orientation of the section of said first channel in which said slider is positioned, said first channel being contoured so that the orientation of said slider, relative to a fixed frame of reference, changes during transit from said slider entry point to said pre-insertion position by more than 90 degrees.

23. The apparatus as recited in claim 22, wherein said first channel is contoured so that the orientation of said slider, relative to said fixed frame of reference, changes during transit from said slider entry point to said pre-insertion position by approximately 180 degrees.

24. The apparatus as recited in claim 20, wherein a first section of said first channel is formed by an air jet rail that is activatable for providing an air jet that propels sliders toward a second section of said first channel.

25. The apparatus as recited in claim 20, wherein each of said sliders has first and second ends and an asymmetric profile when viewed from either end, one of said first and second ends being a closing end and the other of said first and second ends being an opening end, said slider feeder tube being configured to allow entry of each slider only if its first end is leading, and said slider insertion device being configured to insert each slider on said zipper tape so that its second end will be leading when said zipper tape is advanced in said first direction.

26. The apparatus as recited in claim 25, wherein said first end of each slider is its opening end and said second end is its closing end.

27. The apparatus as recited in claim 20, wherein said feeder tube is made of flexible material.

28. A method for inserting a slider on a zipper tape, comprising the following steps:

advancing said zipper tape in a first direction to a position whereat a slider insertion area on said zipper tape is situated in a slider insertion zone;

guiding without carrying a loose slider from a starting point to a transition point where said slider is moving with a velocity component directed in said first direction while maintaining said slider with one end constantly in the lead;

guiding without carrying said loose slider from said transition point to a pre-insertion position opposite said slider insertion area on said zipper tape while maintaining said slider with said one end constantly in the lead, said slider approaching said pre-insertion position by moving in a second direction generally opposite to said first direction; and inserting said slider from said pre-insertion position onto said slider insertion area of said zipper tape.

29. The method as recited in claim 28, wherein the orientation of said slider, relative to a fixed frame of reference, changes by more than 90 degrees during its transit from said transition point to said pre-insertion position.

30. The method as recited in claim 29, wherein the orientation of said slider, relative to said fixed frame of reference, changes by approximately 180 degrees during its transit from said transition point to said pre-insertion position.

* * * * *